United States Patent [19]

Yard

[11] Patent Number: 4,708,664

[45] Date of Patent: Nov. 24, 1987

[54] MULTIPURPOSE BOOT FOR ROUND-TO-FLAT ELECTRICAL CABLE

[76] Inventor: Kenneth Yard, 10 Saratoga Dr., Worcester, Mass. 01606

[21] Appl. No.: 876,671

[22] Filed: Jun. 12, 1986

[51] Int. Cl.[4] ..... H01R 13/56

[52] U.S. Cl. ..... 439/471; 29/868

[58] Field of Search ..... 339/143 R, 103 M, 94 R, 339/99 R

[56] References Cited

U.S. PATENT DOCUMENTS

| | | | |
|---|---|---|---|
| 3,744,128 | 7/1973 | Fisher et al. | 339/143 R X |
| 4,080,035 | 3/1978 | Clark et al. | 339/103 M |
| 4,497,533 | 2/1985 | Genova et al. | 339/143 R |

FOREIGN PATENT DOCUMENTS

| | | | |
|---|---|---|---|
| 2228780 | 1/1974 | Fed. Rep. of Germany | 339/103 M |

*Primary Examiner*—Eugene F. Desmond

*Attorney, Agent, or Firm*—Irving M. Kriegsman

[57] ABSTRACT

A multipurpose boot for use with a jacketed round-to-flat multiconductor electrical cable comprises in one embodiment a sheet of adhesive coated flexible plastic material appropriately cut and scored to define a center panel, a pair of fold-over flaps and a tab. In use, the boot is placed about the cable and secured to the jacket with the end of the conductors lying on the tab. When the end of the cable is inserted into the connector for mass termination the tab is inserted along with it. When the connector is crimped closed the boot effectively connects the connector to the cable jacket so as to physically protect the cable in the area where it is neither flat nor round and to provide strain relief. In an alternate embodiment, the multipurpose boot is attached to the connector, but is not secured to the jacket. Instead, the boot is shaped to include guides for directing the conductors of the cable in a preselected orientation with respect to the connector.

24 Claims, 4 Drawing Figures

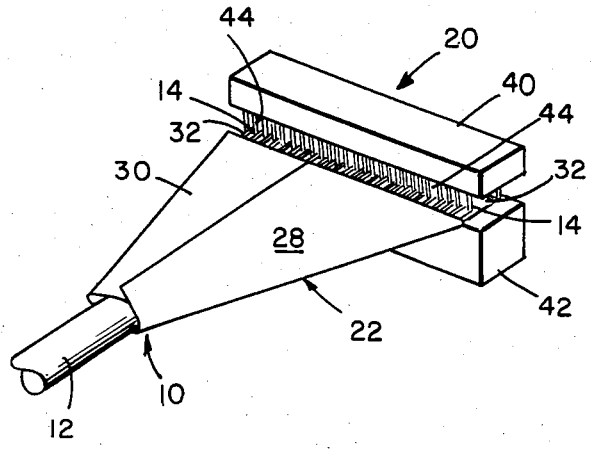
FIG. 5
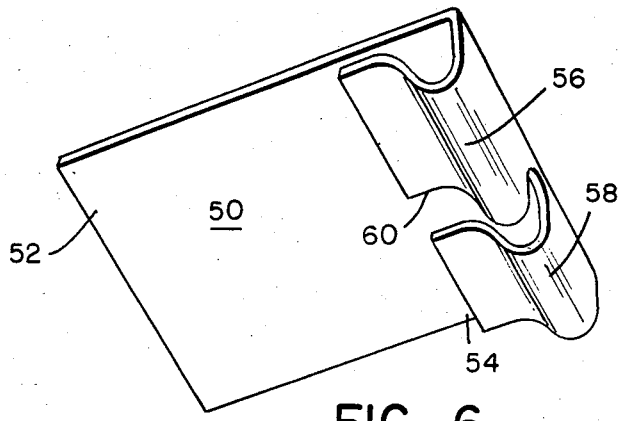
FIG. 6
FIG. 7
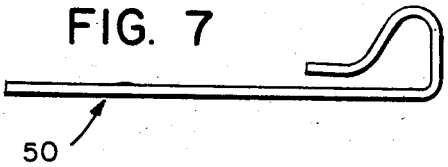
FIG. 8
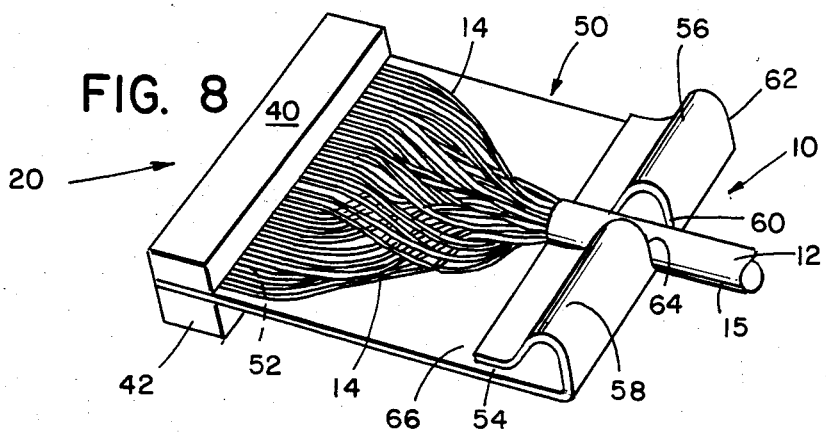

MULTIPURPOSE BOOT FOR ROUND-TO-FLAT ELECTRICAL CABLE

BACKGROUND OF THE INVENTION

The present invention relates generally to multi-conductor electrical cable and, more particularly, to a multipurpose boot for use with round-to-flat type multi-conductor electrical cables.

Two well known and commonly used types of multi-conductor electrical cables are the round cable and the flat cable.

Round multi-conductor electrical cables, that is, multi-conductor electrical cables in which the conductors are individually insulated from one another and arranged in a group or bundle that is circular in cross-section and in which the conductors are jacketed except for the ends and often shielded, have been used in a variety of applications for several decades. The principal advantage of round cable is that it can be easily bent or angled in most any direction over its entire length, as needed. Other advantages of round cable are that it can be easily and relatively inexpensively shielded and jacketed. The main disadvantage of round cable is that when it is being attached to a connector the conductors have to be connected individually and cannot be mass terminated.

Since the mid 1950's with the spectacular growth of the computer industry, the flat, or flat ribbon multi-conductor electrical cable, as it sometime is called, has become increasingly popular, especially as an electrical interconnection for digital equipment. In a flat ribbon type of multi-conductor electrical cable the individual conductors are disposed side by side in a row, electrically separated from each other and fixedly held in such an arrangement by some means, such as tape or plastic. Internal and external interconnection of various functions in computers and other instruments have benefited from the ease of use and compactness of flat ribbon cable. In fact, an entire industry has grown around the manufacture of flat ribbon cable and the necessary connectors, preferably, insulation displacement (IDC) connectors, associated therewith. The main advantage of flat ribbon cable is that when it is being attached to a connector the conductors can be mass terminated (i.e. they do not have to be affixed to the connector individually). The main disadvantage of flat cable is that it cannot be very easily or very conveniently bent or angled to accommodate a particular design requirement. Other disadvantages of flat cable are that the conductors cannot be rearranged to suit particular design needs and that the cable is somewhat more dificult and expensive to shield than round cable.

In response to changing standards imposed by the Federal Communications Commission over the past few years with respect to electromagnetic emissions, shielded versions of these cables and the connectors associated therewith are now available. As a result thereof, these flat cables and connectors have dramatically increased in size and expense.

In order to overcome the problems noted above associated with flat ribbon electrical cable, a combination of a round type cable and a flat type cable has been developed over the last several years; that is, a cable which is flat at the ends with flexible conductor alignment and essentially round between the ends where it can be easily bent. The conductors are usually enclosed in a jacket over the portion of the cable between the ends where the cable is round, shielded if desired, and held in the proper side by side alignment at the ends by strips of tape so that the ends can easily be mass terminated. Such a development has also overcome the crowding and air circulation problems heretofore associated with flat ribbon cable. This recent improvement in flat ribbon cable has been referred to as "round-to-flat" multi-conductor electrical cable, since it is round except for the ends and then flat at the ends. Another advantage of this type of cable over flat ribbon cable is that the conductors can be easily positioned at the ends relative to each other to suit a particular application. Electrical tests for crosstalk and impedance uniformity of round-to-flat multi-conductor cables have proven such cables to be electrically superior to both the shielded and unshielded flat ribbon cable of the past. An example of a round-to-flat multi-conductor cable can be found in an article by Darrell Fernald entitled, "An Alternative to Flat Ribbon Cable," *Electri-Onices*, Dec. 1984.

A number of drawbacks have, however, been associated with the round-to-flat multi-conductor cable. One problem occurs after the cable has been attached to a connector in the portion of the cable where the configuration changes from round to flat; that is, between the ends where the cable is flat and the jacket where the cable configuration is round.

More specifically, in the portion between the connector where the conductors are arranged flat and the jacket where the conductors are round (and hereinafter referred to as the transition area) the conductors are in a loose bundle, are not jacketed, and are not held in any particular alignment. Consequently, any pulling, accidental or intentional, of one or more of the conductors in this transition area may cause these conductors so strained to tear away from the connector to which they are attached. Since the conductors are not attached to each other in the transition area any strain applied to any one particular conductor will not be spread out over the other conductors. Additionally, the conductors in this area are vulnerable to abrasion and other undesirable effects of the surrounding environment. Even further is the concern associated with the positioning of the conductors over this area to provide a desired angular orientation of the cable with respect to the connector to which it is attached or other associated electronic equipment. For example, it has proven difficult to easily and compactly make a ninety degree bend over this area in any direction since loose wires will tend to spread out and end up in a multitude of directions.

Another disadvantage of round-to-flat cable is that because the conductors in the transition area are loose they have a tendency to snag or catch on sharp edges, such as may be present on printed circuit boards, as the cable is being slid into a chassis or housing to its intended position.

In the past, an attempt has been made to solve some of the problems associated with round-to-flat cables over the transition area by placing a piece of shrink tubing, such as a heat shrinkable plastic, over the uncovered conductor portions and then shrinking the tubing (by heat) down to a tight fit. Although this arrangement does provide physical protection of the conductors against electrical shorts where they are not jacketed, it does not provide any strain relief against the individual conductors and in many instances distorts the alignment of wires.

Another technique that has been employed in the past for providing protection and strain relief of the conductors in the transition area has involved using an attachment referred to in the art as a back shell. This attachment, which is made of either metal or a rigid plastic, comprises two mating shell shaped sections which when mounted on the cable fit over the end of the jacketing in the round portion, fit over the conductors in the transition area and fit around and clamp over the connector. Advantages of the back shell are that it does protect the wires in the transition area and does indirectly connect the jacket in the round portion to the connector so as to provide strain relief of the individual wires. The disadvantages of the back shell are that it is cumbersome, bulky, not flexible, expensive to fabricate and is limited in use to only the particular sized and shaped connector for which it is constructed. As can be appreciated there are a variety of different sized and shaped connectors.

As is apparent, a great need exists to provide an effective means of alleviating the above-mentioned problems associated with round-to-flat multi-conductor electrical cable.

SUMMARY OF THE INVENTION

The present invention overcomes the problems set forth hereinabove by providing according to one embodiment of the invention a thin, low profile, flexible, multipurpose boot for incorporation with a round-to-flat multi-conductor electrical cable. The boot has the capability of protecting the conductors against adverse external conditions while simultaneously providing relief from undesirable strain which may be placed on the conductors. Several versions of this embodiment are disclosed. In another embodiment of the present invention, the boot is configured so as to selectively position and neatly maintain the conductors, as a group, in any one of a number of predetermined different angular orientations with respect to the connector to which it is attached so as to accommodate a wide variety of uses to which the round-to-flat cable may be utilized. Also, as will hereinafter become readily apparent, the invention can be utilized with all type of insulation displacement (IDC) type connectors.

More specifically, in the first embodiment of the present invention the boot is made of a single sheet of flexible plastic material such as PVC, polyester or polyurethane. The sheet has a unique configuration which enables it to encompass the unjacketed and loosely bundled portion of the conductors and at the same time be fixedly secured to the connector to which the cable may be attached in a unique manner as well as to the jacket of the cable. This configuration enables the plastic material to form a boot which acts not only as a means of protecting the conductors, but also because of its shape and method of assembly as a means of substantially eliminating undesirable strain which may be placed on the conductors in the transition area. The strain relief is accomplished by inserting a tab integrally formed at one end of the boot directly into the connector along with the ends of the conductors of the round-to-flat cable and securing the other end of the boot to the (round) jacket of the cable with a suitable adhesive. When the top and bottom sections of the connector are crimped shut the boot and the ends of the conductors are secured therein with the boot effectively connecting the connector to the jacket of the cable. Further strain relief is obtained by securing the boot to the conductors in the transition area. Additionally, by coating the side of the tab in contact with the conductor ends with an adhesive the connector carrier tape generally associated with the flat conductor ends of conventional round-to-flat cable can be eliminated, if so desired.

Although the present invention can be fabricated from a number of individual pieces of material secured to each other, it is preferred in the first embodiment that the uniquely configured boot be formed from a single sheet of flexible plastic material. Any suitable adhesive can be used to maintain the boot in place about the conductors and jacket. Although a number of plastics may be utilized with this invention, it is important to realize that heat shrinkable plastic tubing cannot be used with the present invention since amongst other things it distorts the alignment of wires and is therefore unacceptable in providing for the strain relief afforded by the present invention. In the second embodiment of the present invention, the unique configuration of the boot permits the conductors to extend from the boot in any one of three different orientations the particular direction depending on particular design requirement. In particular, the round-to-flat cable may extend directly from the connector or, if desired, extend neatly and compactly at selected angular bends either to the right or left thereto. This embodiment of the present invention is especially beneficial when the round-to-flat cable is used in a cramped situation in which it is desirable that the connector extend at right angles to the cable.

It is therefore an object of this invention to provide a multipurpose boot for a round-to-flat cable that is designed specifically for use in overcomming problems in the transition area where the cable changes from flat to round.

It is another object of this invention to provide a multipurpose boot which protects the conductors of a round-to-flat cable from adverse external conditions in the area noted above.

It is still another object of this invention to provide a multipurpose boot which prevents undesirable strain from adversely affecting the conductors of a round-to-flat cable in the area noted above, and also prevents snagging of the cable conductors on sharp edges during installation or maintenance work.

It is a further object of this invention to provide a multipurpose boot which holds the conductors of a round-to-flat cable in an appropriate position prior to and during insertion into a connector for mass termination. It is an even further object of this invention to provide a multipurpose boot which is utilized to properly and neatly orient the conductors of a round-to-flat cable with respect to a connector to which it is affixed in any one of a plurality of angular positions.

It is still another object of this invention to provide a unique method of making the multipurpose boot of the present invention.

It is still a further object of this invention to provide a multipurpose boot for round-to-flat cable which is economical to produce, has a minimum number of parts, and is highly effective in operation.

For a better understanding of the present invention, together with other and further objects thereof, reference is made to the following detailed description, taken in connection with the accompanying drawings, and its scope will be pointed out in the appended claims.

BRIEF DESCRIPTION OF THE DRAWINGS

FIG. 5 is a pictorial representation of the cable and boot shown in FIG. 4 mounted on a connector with the top and bottom sections of the connector not fully clamped closed;

FIG. 6 is a perspective view of another embodiment of the invention;

FIG. 7 is a right end view of the embodiment of the invention shown in FIG. 6;

FIG. 8 is a pictorial representation of the embodiment of FIG. 6 as assembled on a round-to-flat cable and connector with the cable extending straight out from the connector;

DETAILED DESCRIPTION OF THE PREFERRED EMBODIMENTS AND METHOD

Figure 1:
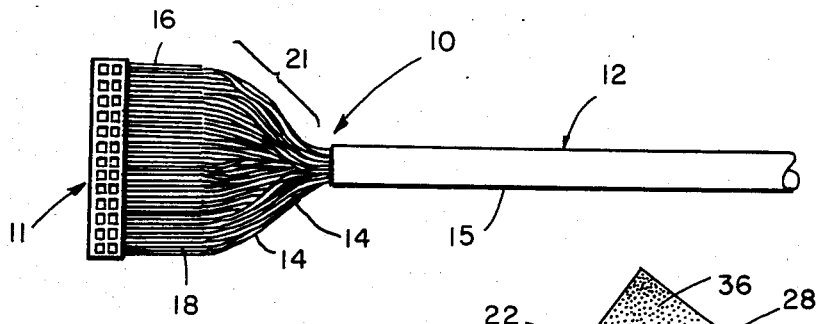
FIG. 1 is a plan view broken away in parts of a conventional round-to-flat cable attached at one end to a conventional connector.

Reference is now made to FIG. 1 of the drawings which illustrates a conventional round-to-flat cable 10 attached at one end to a connector 11. Cable 10 and connector 11 are each of the type more fully described in the Background of the Invention and in the above-referred to article in *Electric-Onics*. For simplicity, only one end of cable 10 is shown. Cable 10 includes a round portion 12 in which a plurality of conductors 14 (which make up the cable) are intertwined and enclosed in a jacket 15 and an end portion 16 in which the ends of conductors 14 are positioned side-by-side in a row. The conductors 14 at end portion 16 are held in their side-by-side position by a rectangular strip of conventional carrier tape 18 which is transparent and which is provided with an adhesive coating on the side facing the conductors. End portion 16 extends into and is clamped between the top and bottom sections of connector 11, which may be a commonly available IDC type connector, with the conductor ends in engagement with the tines in the connector. As clearly illustrated in FIG. 1 of the drawings, there is also a transition portion 21 of cable 10 between carrier tape 18 and jacket 15 where conductors 14 are neither in a flat configuration or a round configuration. They are not enclosed within jacket 15 but rather are in a loose bundle. As such, they subject cable 10 to a multitude of problems as noted above including shorting against another element, inadvertant strain with the resultant displacement from the connector, snagging onto sharp edges and difficulty of appropriate angular positioning with respect to connector 11.

The multipurpose boot 22 of the present invention (See FIGS. 2 through 5) which alleviates the problems described above is clearly illustrated in the drawings and will now be described in detail.

Figure 3:
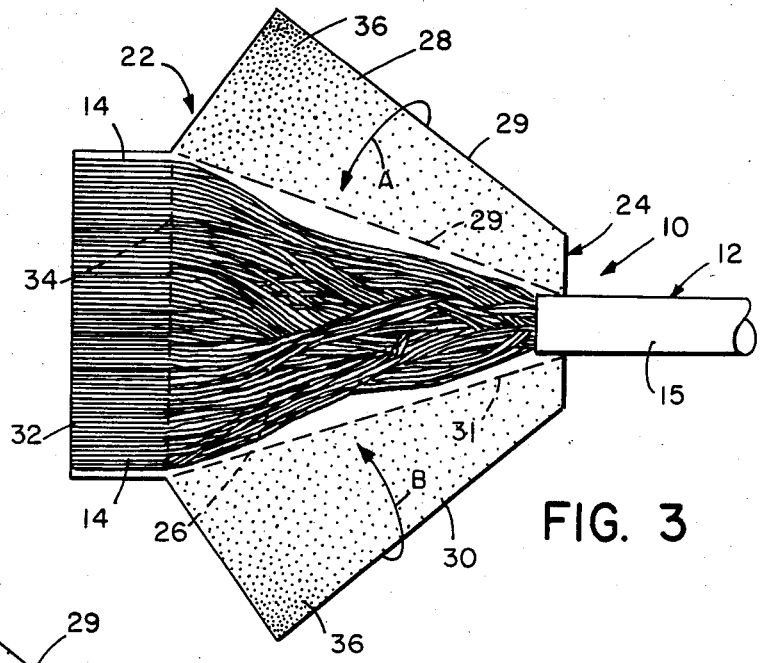
FIG. 3 is a plan view showing the multipurpose boot shown in FIG. 2 in position for attachment to a round-to-flat cable.
Figure 2:
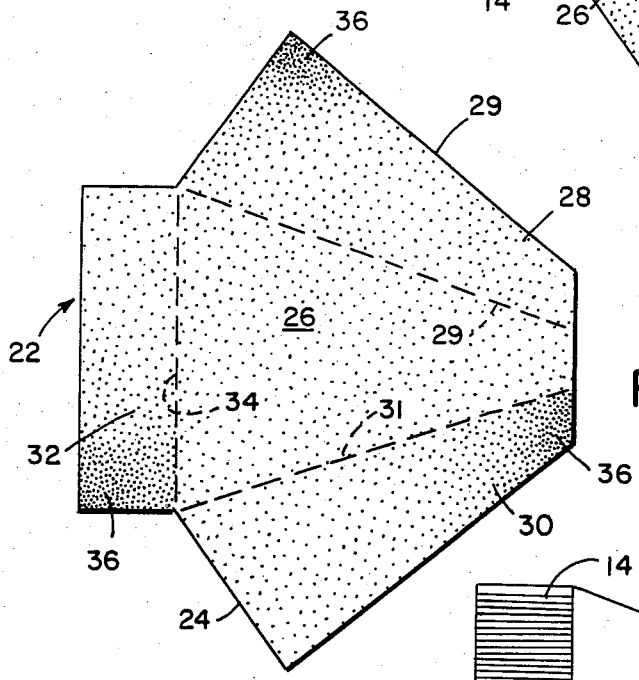
FIG. 2 is a plan view taken from the top of one embodiment of a multipurpose boot of the present invention in an unfolded position prior to assembly onto a cable.
Figure 4:
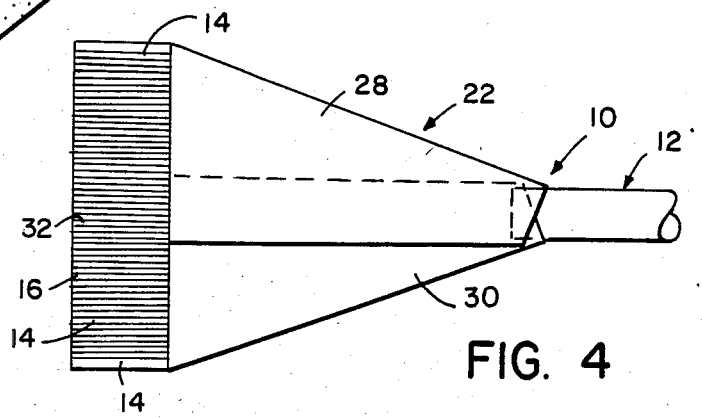
FIG. 4 is a plan view of the multipurpose boot and round-to-flat cable of FIG. 3 with the boot attached to the cable.

As shown in the drawings, multipurpose boot 22 is preferably formed of a single sheet 24 of a flexible material such as a flexible plastic. The actual shape and size of boot 22 may vary according to the angle the cable is to form relative to the connector to which it is attached and the size (length) of the connector. Sheet 24 is cut and scored to define a generally triangular-shaped central panel 26. A pair of opposite, top and bottom, four-sided flaps 28 and 30 extend from top and bottom edges 29 and 31, respectively, of central panel 26, and a generally rectangular tab 32 extends out from side edge 34 of the central panel 26. This unique configuration is clearly shown in FIG. 2 and as can be seen in FIG. 3, when it is to be attached to a cable 10 enables the flaps 28 and 30 to be folded up and over in the direction of arrows A and B to the overlapping position shown in FIG. 4 so as to form a cover over transition portion 21 of cable 10. As can be seen in FIG. 4, conductors 14 at end portion 16 lie upon tab 32 for subsequent insertion into connector 20 in the manner described in detail hereinbelow. Additionally, as shown in FIG. 2, flaps 28 and 30, tab 32 and panel 26 have a coating of an adhesive 36 such as a heat sealable or pressure sensitive adhesive thereon. It should also be noted that as can be seen in FIGS. 3 and 4 boot 22 also extends over the end of jacket 15 and is secured to jacket 15 by adhesive 36 when assembled in place.

It is of utmost importance in the invention that although a number of different flexible plastic material such as PVC, polyester or polyurethane may be utilized with the present invention, the use of a heat shrinkable plastic material is unacceptable. As noted above, tab 32 which extends out from side edge 34 of triangular-shaped central portion 26 of boot 22 also has incorporated therewith a coating of an adhesive 36. As can be appreciated, since adhesive 36 holds the conductors 14 in place on tab 32 in side by side flat arrangement, carrier tape such as used in the cable in FIG. 1 may, if desired, be eliminated, and accordingly is not shown in FIG. 3.

As clearly depicted in FIG. 3, when boot 22 is being attached to cable 10 the conducotrs 14 are placed on the substantially triangular-shaped portion 26 of boot 22 with the ends of the conductors 14 resting on tab 32. Thereafter flap 30 is folded over conductors 14. Flap 28 is then folded over flap 30. Thereafter, heat is applied to activate the adhesive 36 if it is heat sealable or pressure if it is pressure sensitive and bond the boot 22 in place over conductors 14 and to the end of jacket 15 on cable 10. It is important to note that the plastic is not heat shrinkable and that the heat merely activates the adhesive, although other types of non-heat sealable adhesives may be utilized with the present invention. Cable 10, with boot 22 attached thereto is shown in FIG. 4.

After boot 22 encompasses conductors 14 and the end of jacket 15 and is secured in place, calbe 10 is attached to connector 11 by inserting end 16 of cable 10 thereof, including tab 32 of boot 22 between the top and bottom parts 40 and 42, respectively of electrical connector 11 (see FIG. 5). The connector sections 40 and 42 are then clamped together, as is customary with this type of connector, securing end portion 16 of cable 10 and tab 32 therebetween. As is clearly evident by the illustration of FIG. 5, the teeth or tines 44 of connector 11 not only provide the appropriate electrical contact with conductors 14 but also fixedly secure tab 32 of boot 22 to connector 11.

Instead of attaching boot 22 first to cable 10 and then to connector 11, boot 22 may be attached first to connector 11 and then to cable 10.

With the arrangement depicted in FIG. 5 of the drawings, boot 22 serves a multipurpose. It provides strain relief for conductors 14 by the clamping of tab 32 between sections 40 and 42 of connector 20 since the conductors are all attached to the boot which in turn is attached to the connector. In addition, the conductors 14 are no longer exposed to adverse environmental effects and wear of the conductors 14 is substantially reduced. Furthermore, since tab 32 can also be used to securely position conductors 14 in place in a side by side row (by its adhesive coating), carrier tape is not needed.

Instead of fabricating boot 22 from a single sheet of material, boot 22 may be made of two sheets of adhesive coated material similar in shape to the FIG. 2 embodiment but without the flaps 28 and 30, one sheet positioned below the cable and the other above the cable.

There are instances in which it is desirable to direct conductors 14 at a preselected orientation with respect to electrical connector 20. For such instances another embodiment of the present invention is depicted in FIGS. 6 through 9 of the drawings.

Figure 9:
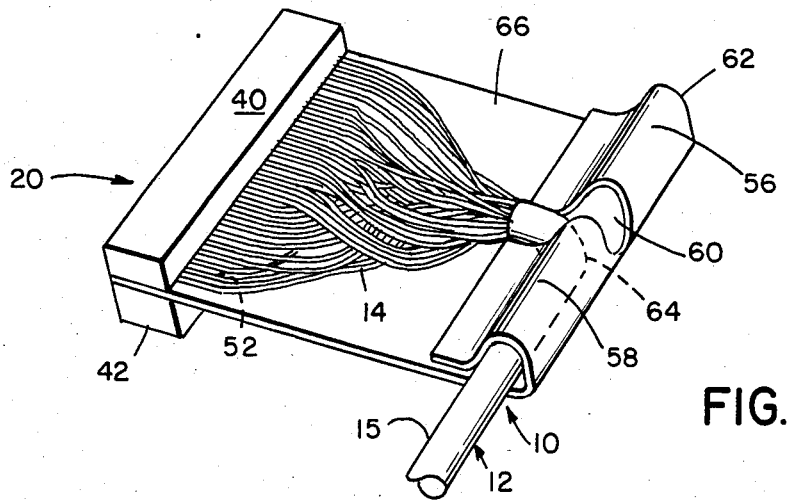
FIG. 9 is a pictorial representation of the embodiment of FIG. 6 as assembled on a round-to-flat cable and connector with the cable extending out from the connector at a 90 degree bend.

In the embodiment of the present invention shown in FIGS. 6 through 9, boot 50 is made of an elongated generally rectangular sheet of more rigid plastic material having one end 52 thereof which is adapted to be inserted along with ends 17 of cable 10 between sections 40 and 42 of connector 11. The other end 54 of boot 50 is preformed into a pair of bendable guides 56 and 58 having a space or slot 60 formed therebetween. The guides 56 and 58 are identical in design and are so configured as to provide passageways 62 and 64, respectively, therein. As a result of this construction, the conductors 14 can either pass directly through space 60 as shown in FIG. 8 of the drawing so that cable 10 extends out normally to connector 40, or be directed to pass through either one of the passageways 62 or 64 as illustrated in FIG. 9 of the drawings so that cable 10 extends out at a ninety degree bend. Since guides 56 and 58 are bendable, it is relatively easy to lift the guides 56 and 58 from the bottom surface 66 of boot 50 in order to direct the conductors through the appropriate passageway 62 or 64.

This latter embodiment of the present invention provides a boot that is also effective to a degree in reducing strain on the individual conductors 14 as well as providing limited protection from the elements to the exposed conductors 14. Also, in similar manner described with boot 22, the multipurpose boot 50 can be used as a conductor positioning means in place of carrier tape 18 by applying an adhesive coating to end 52.

Figure 10:
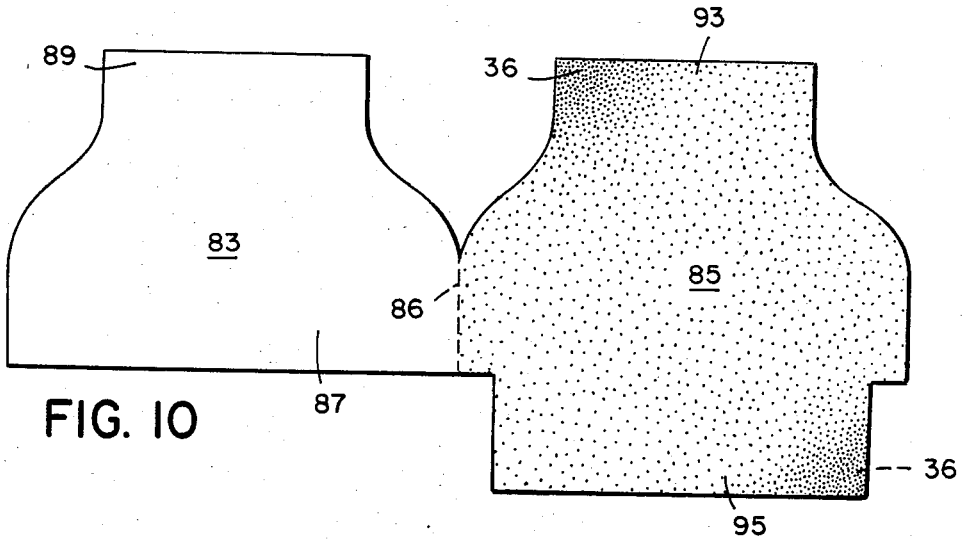
FIG. 10 is a plan view of a variation of the embodiment shown in FIG. 2.

In FIG. 10 there is shown a variation of the boot shown in FIG. 2, the variation being identified by reference numeral 81. Boot 81 is made of a sheet of flexible plastic material cut and scored to define a left section 83 and a right section 85 separated by a fold line 86. Left section 83 includes a main panel 87 having a top portion 89. Right section 85 includes a main panel 91 having a top portion 93 and a bottom tab portion 95. Adhesive 36 is provided on right section 85. In use cable 10 is placed on right section 85 such that cable ends 17 are on tab 95 with top portions 89 and 93 overlapping and being secured to the jacket of the cable 15. Left section 83 is then folded over on top of cable 10 and secured to right section 85. Tab portion 95 and the cable ends are then inserted into connector 11.

Figure 11:
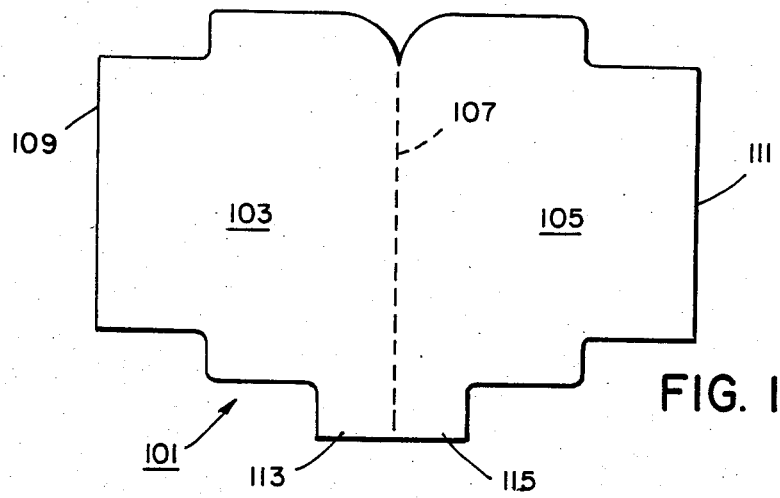
FIG. 11 is a plan view of another variation of the embodiment shown in FIG. 2.

Another variation of the FIG. 2 embodiment is shown in FIG. 11. This variation for use with a cable in which the conductor ends are at a 90 degree angle to the longitudinal axis of the cable end identified by reference numberal 101 comprises a sheet of flexible plastic material cut and scored to define a left section 103 and a right section 105 separated by a fold line 107. Each section 103, 105 contains a connector engaging tab 109 and 111, respectively and a jacket encompassing projection 113 and 115, respectively. Alternatively, tab 111 may be omitted. A coating of adhesive 36 is deposited on one section, such as section 103. In use, the two sections 103, 105 are folded over onto cable 10 and secured to each other and to the cable jacket by adhesive 36 with tabs 109 and 111 sandwiching the wire ends 17 and panels 113 and 115 engaging the cable jacket 15.

If desired, a sheet of conductive foil for use as shielding may be disposed inside boot 22, 83, 101 or any variations thereof the size and shape of the foil conforming to the size and shape of the boot.

It is to be understood that although the present invention has been described with reference to particular embodiments and method of assembling those embodiments, it is also to be understood that various modifications and changes may be made as fall within the spirit and scope of the invention as set forth in the appended claims.

What is claimed is:

1. A cable system comprising an insulation displacement connector, a round-to-flat multiconductor cable and a multipurpose boot, said cable having an end portion where the conductors are in a flat configuration, a round portion where the conductors are in a round configuration and enclosed in a jacket and a transitory portion between said end portion and said round portion where the conductors are not in a round configuration, not jacketed and not in a flat configuration, said connector having a top section, and a bottom section, one of said sections having a plurality of tines, said boot comprising a sheet of flexible material at least partially encompassing said conductors in said transitory portion and having a tab portion extending together with said end portion of said cable into and clamped between said top section and said bottom section of said connector and in contact with said times in said connector.

2. A system as defined in claim 1 wherein said sheet of flexible material is nonconductive and substantially encloses said conductors in said transitory portion of said round-to-flat cable.

3. A system as defined in claim 2 wherein said sheet of flexible material is made from plastic.

4. A system as defined in claim 3 wherein said sheet of flexible plastic material has a central portion and a pair of flaps which are adapted to overlap each other to substantially enclose said conductors in said transistory portion and said end of said jacket.

5. A system as defined in claim 3 wherein said sheet of flexible plastic material includes a left section and a right section, said right section being connected to said left section by a fold line.

6. A system as defined in claim 5 wherein each section includes a jacket engaging portion.

7. A system as defined in claim 3 wherein said sheet has an adhesive associated therewith for securing said boot to said jacket.

8. A multipurpose boot as defined in claim 7 wherein said adhesive associated therewith is non-conductive.

9. A system as defined in claim 7 wherein said adhesive is heat sealable and said sheet of flexible material is not heat shrinkable.

10. A system as defined in claim 3 wherein said plastic is selected from the group consisting of PVC, polyester and polyurethane.

11. A system as defined in claim 1 wherein said sheet of flexible material is nonconductive and is shaped for directing said conductors in a preselected orientation with respect to said electrical connector.

12. A system as defined in claim 11 wherein said sheet of flexible material is shaped to guide said conductors at one of three directions with respect to said electrical connector.

13. A system as defined in claim 12 wherein said sheet of flexible material is shaped to include two wrap around portions spaced apart from each other each forming a guide for said conductors to pass directly therethrough.

14. A system as defined in claim 13 wherein said sheet of material is a semi-rigid plastic.

15. A round-to-flat electrical cable comprising:

a. a plurality of conductors arranged in a round configuration over its length, a flat configuration at at least one end and in a loose bundle between said end and the round portion, b. a jacket over the round portion; and c. a boot over the loose bundle and secured to said jacket, said boot including a tab extending over said end and adapted to fit into an insulating displacement connector along with the conductors at said end.

16. The cable of claim 15 and further including a sheet of shielding between said boot and said conductors.

17. A method of assembling a multipurpose boot onto a jacketed round-to-flat multiconductor electrical cable for protecting the transitory portion thereof, said method comprising the steps of:

a. providing a single sheet of plastic material having at least one main portion, a connector engaging tab and a jacket encompassing portion;

b. applying a heat sealable adhesive to said sheet to secure said sheet to said jacket;

c. positioning said conductors in said transistory portion of said round-to-flat cable upon said main portion of said sheet of plastic material such that the flat ends of said conductors rest upon said tab;

d. securing said sheet to said jacketed portion of said round-to-flat cable; and e. inserting said tab and said ends of said conductors into an electrical connector.

18. A method of fabricating a multipurpose boot as defined in claim 17 further comprising the step of securing said ends of said conductors to said tab prior to insertion into said electrical connector.

19. A method of connecting one end of jacketed round-to-flat multiconductor electrical cable to an insulation displacement type connector, said cable having a flat end, a round portion and a transitory portion between said flat end and said round portion, said method comprising the steps of:

a. providing a sheet of non-conducive flexible material having a main portion, a connector engaging tab portion and a jacket encompassing portion;

b. positioning said cable upon said sheet of flexible material such that the end of the cable is resting on the tab portion, the transitory portion of the cable is resting on the main portion and the round portion of the cable is resting on the jacket encompassing portion;

c. securing said round portion of said round-to-flat cable to said jacket encompassing portion;

d. inserting said tab and said end of said cable into said connector; and e. crimping said connector shut.

20. A method as defined in claim 19 further comprising the steps of applying a heat sealable adhesive to said sheet to secure said sheet to said round portion of said cable.

21. A method as defined in claim 19 further comprising the step of securing said end of said cable to said tab prior to insertion into said connector.

22. A round-to-flat cable system comprising:

a. an insulation displacement connector, said connector having a top section and a bottom section;

b. a round-to-flat multiconductor electrical cable, said cable having a jacketed portion where the conductors are in a round configuration, an end portion where the conductors are in a flat configuration and a transitory portion where the conductors are neither in a round configuration nor a flat configuration, said end portion of said cable extending into and being clamped between said top and bottom sections of said connector, and c. a boot made of nonconductive material, said boot being fixedly attached to said jacketed portion and extending into and being clamped between said top and bottom sections of said connector along with said end portion of said cable for providing protection for said conductors in said transitory portion of said cable and for providing strain relief for said cable.

23. The invention of claim 22 and wherein said boot is made from a sheet of flexible plastic material.

24. The invention of claim 23 and wherein one section of said connector has a plurality of tines and wherein the boot is in contact with the tines.

* * * * *